US008281844B1

(12) United States Patent
Zacchia

(10) Patent No.: US 8,281,844 B1
(45) Date of Patent: Oct. 9, 2012

(54) SECTIONAL OVERHEAD DOOR

(76) Inventor: Gary R. Zacchia, Fairfield, CT (US)

( * ) Notice: Subject to any disclaimer, the term of this patent is extended or adjusted under 35 U.S.C. 154(b) by 280 days.

(21) Appl. No.: 12/643,677

(22) Filed: Dec. 21, 2009

Related U.S. Application Data

(63) Continuation-in-part of application No. 12/621,096, filed on Nov. 18, 2009, now abandoned.

(60) Provisional application No. 61/199,584, filed on Nov. 19, 2008.

(51) Int. Cl.
*E05D 15/16* (2006.01)

(52) U.S. Cl. ..... 160/201; 160/232

(58) Field of Classification Search ..... 160/201, 160/232, 379, 229.1; 52/455, 456, 457, 311.1; 49/198, 197
See application file for complete search history.

(56) References Cited

U.S. PATENT DOCUMENTS

| | | | | |
|---|---|---|---|---|
| 4,114,664 | A | 9/1978 | Cotton | |
| 4,630,420 | A | 12/1986 | Hagemeyer | |
| 4,704,834 | A | 11/1987 | Turner | |
| 4,706,431 | A | 11/1987 | Corvese | |
| 4,716,700 | A | 1/1988 | Hagemeyer | |
| 5,285,608 | A * | 2/1994 | Costello | 52/456 |
| 5,361,552 | A * | 11/1994 | Fulford | 52/455 |
| 5,438,808 | A * | 8/1995 | Costello | 52/316 |
| 5,766,774 | A | 6/1998 | Lynch et al. | |
| 5,775,041 | A * | 7/1998 | Tull et al. | 52/455 |
| 5,782,055 | A | 7/1998 | Crittenden | |
| 5,887,402 | A | 3/1999 | Ruggie et al. | |
| 5,937,587 | A * | 8/1999 | Zinbarg | 52/3 |
| 6,095,229 | A * | 8/2000 | Kellogg et al. | 160/201 |
| 6,098,697 | A * | 8/2000 | Krupke et al. | 160/229.1 |
| 6,148,896 | A * | 11/2000 | Pinto et al. | 160/229.1 |
| 6,227,278 | B1 * | 5/2001 | Forsland | 160/107 |
| 6,446,695 | B1 * | 9/2002 | Forsland | 160/201 |
| 6,553,735 | B1 | 4/2003 | Wang Chen | |
| 6,586,085 | B1 * | 7/2003 | Jella | 428/319.1 |
| 6,948,547 | B2 * | 9/2005 | Maher | 160/201 |
| 6,951,237 | B2 * | 10/2005 | Mullet | 160/201 |
| 7,043,331 | B2 | 5/2006 | Sigtryggsson et al. | |

(Continued)

FOREIGN PATENT DOCUMENTS

| | | |
|---|---|---|
| GB | 2285772 | 7/1995 |

(Continued)

OTHER PUBLICATIONS

Eden Coast, LLC, Eden Coast Garage Doors, http://www.edencoast.com.

*Primary Examiner* — Katherine W Mitchell
*Assistant Examiner* — Johnnie A Shablack
(74) *Attorney, Agent, or Firm* — Day Pitney LLP

(57) ABSTRACT

The disclosed door and method for manufacturing the same allows a door manufacturer to more easily fabricate custom sectional overhead doors. The disclosed door and method for manufacturing the same eliminates the expense of having a skilled craftsman hand mill and fit each trim hoard. The disclosed door and method for manufacturing the same enables fabricating infinite designs and infinite sizes without the constraint of being limited to preset, expensive platens/dies for fabrication. The disclosed door and method for manufacturing the same provides for routing typical depth panels into a door without having to penetrate various layers of the door. The disclosed door and method for manufacturing the same provides a solid core of insulation which is not subject to routing which decreases thermal resistively of the door.

21 Claims, 5 Drawing Sheets

U.S. PATENT DOCUMENTS

| | | | | |
|---|---|---|---|---|
| 7,059,380 | B2 * | 6/2006 | Bennett et al. | 160/229.1 |
| 7,185,468 | B2 * | 3/2007 | Clark et al. | 52/455 |
| 7,383,872 | B1 * | 6/2008 | Jella | 160/236 |
| 7,438,114 | B2 * | 10/2008 | Fowler | 160/209 |
| 7,721,500 | B2 * | 5/2010 | Clark et al. | 52/455 |
| 7,832,166 | B2 * | 11/2010 | Daniels | 52/455 |
| 2004/0163776 | A1 * | 8/2004 | Brown et al. | 160/229.1 |
| 2004/0172914 | A1 * | 9/2004 | Lancia | 52/784.1 |
| 2005/0056381 | A1 * | 3/2005 | Truman | 160/133 |
| 2005/0092447 | A1 * | 5/2005 | Mock | 160/201 |
| 2005/0144871 | A1 * | 7/2005 | Bunker, II | 52/455 |
| 2005/0194106 | A1 * | 9/2005 | Scales | 160/201 |
| 2006/0185801 | A1 * | 8/2006 | Ni et al. | 160/201 |
| 2006/0272253 | A1 * | 12/2006 | Wolf et al. | 52/455 |
| 2007/0106417 | A1 | 5/2007 | Barbir | |
| 2007/0175602 | A1 * | 8/2007 | Ni et al. | 160/201 |
| 2007/0251160 | A1 * | 11/2007 | Bunker, II | 52/79.1 |
| 2007/0267155 | A1 * | 11/2007 | Howe et al. | 160/232 |
| 2008/0135192 | A1 * | 6/2008 | Truman | 160/229.1 |
| 2009/0044471 | A1 * | 2/2009 | Harlin et al. | 52/309.13 |
| 2009/0113830 | A1 * | 5/2009 | Clark et al. | 52/455 |
| 2009/0223131 | A1 * | 9/2009 | Wiese | 49/197 |
| 2010/0018093 | A1 * | 1/2010 | O'Sullivan | 40/600 |
| 2010/0077664 | A1 * | 4/2010 | Stensland | 49/197 |
| 2010/0269414 | A1 * | 10/2010 | Horton | 49/197 |

FOREIGN PATENT DOCUMENTS

| | | |
|---|---|---|
| GB | 2393634 | 4/2004 |
| WO | 9212016 | 7/1992 |

* cited by examiner

SECTIONAL OVERHEAD DOOR

CONTINUITY

This application claims priority to U.S. patent application Ser. No. 12/621,096, filed Nov. 18, 2009, which claimed priority to U.S. Provisional Patent Application No. 61/199,584, filed Nov. 19, 2008, both of which are incorporated herein by reference.

BACKGROUND OF THE DISCLOSED EMBODIMENTS

1. Field of the Invention

The application relates to doors and their methods of manufacturing.

2. Background of the Related Art

Custom overhead doors are typically fabricated with a flush door as a base door. On the base door, hand milled trim boards are fitted to the specified design. While this produces a beautiful product with infinite designs and sizes, it is very time consuming and therefore expensive.

One alternative to the above mentioned door fabrication process is to laminate a sheet of material over the frame. Such a sheet material is typically pre-formed into a design using platens/dies. The benefits of this method is that it is less expensive than assembling hand milled trim.

One problem with using dies and platens is that variations in designs and sizes are limited due to related equipment and storage costs. That is, for designs based on customer-specific tastes, which may be unique, dies or platens must be fabricated or obtained. Once used, the dies or platens would need to be stored for the unlikely event that another customer would have the same design for the same sized door.

More recently, methods have been introduced which attempt to fabricate a sectional-overhead door, such as a garage door, with the use of a CNC (Computer Numerical Control) milling machine. Utilizing a CNC bypasses the need to use dies and platens for creating door designs. However, such'methods, as will be explored, fail to provide a sectional-overhead door having the characteristics and benefits of the disclosed embodiments of the invention.

U.S. Patent Publication No. 2004/0172914 to Barbir, published on May 10, 2007, incorporated herein by reference, discloses a "Seamless Door and Method of Manufacture." The door is comprised of an MDF (medium density fiber board) core suitable for routering without chip-out, and the core thickness is between 1⅜" and 2¼" thick. The door also includes vertical members, a ⅛" veneer which covers the front and back of the door, and edging which covers the peripheral edges of the door. Once the door is formed, the '914 publication teaches carving a predetermined profile into the front face, back face, or both with a CNC.

One problem associated with the '911 publication is the depth of the veneer. Typical panels in a multi-paneled door are more than one half of an inch deep. By using a CNC on a ⅛' veneer, router bits will necessarily drill in to the core material, exposing edges between the veneer and the core. Moisture and typical and heating and cooling cycles in an outdoor environment will cause the veneer to pull away from the core. Furthermore, using an MDF core as compared to a foam insulated core will provide the door with relatively poor insulating characteristics and significant extra weight.

U.S. Pat. No. 7,185,468 to Clark et al, granted on Mar. 6, 2007, discloses a "Multi-Layered Fire Door And Method For Making The Same." Similar to the '914 publication, the '468 publication discloses various layers, including outer veneers which are about ⅛" thick. As acknowledged in the reference, at column 7, lines 30-50, panels comprised of grooves which are at least a half inch deep could not be manufactured into such doors without penetrating multiple layers of the door.

U.S. Pat. No. 5,782,055 to Crittenden, granted on Jul. 21, 1998, incorporated herein by reference, discloses a "Door Apparatus and Method of Making Door." The disclosed method comprises the asymmetrical removal of material from the inner portion of the door, inwardly from the perimeter door frame, on both sides of the door. The result is relatively thin webs between relatively thick door portions, as illustrated in FIGS. 2 and 3 of the publication. This provides a serpentine configuration which expands and contracts in response to temperature and/or humidity conditions.

As with the '914 publication, the core of the door in the '055 publication is the material which is routed. Therefore, the core is wood and not an insulating product. Moreover, in the area of the thin webs, the wood is very thin, further decreasing the insulation characteristics of the door.

Another issue with a door manufactured according to the '055 publication is that the thin webs form weak areas in the door. Those areas will fracture under relatively light impact as compared with the rest of the door. Such weakness would be problematic as garage door designs are typically subjected to impacts during a normal lifespan.

SUMMARY OF THE DISCLOSED EMBODIMENTS

In view of the options discussed above, the disclosed door and method for manufacturing the same allows a door manufacturer to more easily fabricate custom sectional overhead doors. The disclosed door and method for manufacturing the same eliminates the expense of having a skilled craftsman hand mill and fit each trim board. The disclosed door and method for manufacturing the same enables fabricating infinite designs and infinite sizes without the constraint of being limited to preset, expensive platens/dies for fabrication. The disclosed door and method for manufacturing the same provides for routing typical depth panels into a door without having to penetrate various layers of the door. The disclosed door and method for manufacturing the same provides a solid core of insulation which is not subject to routing which decreases thermal resistively of the door.

BRIEF DESCRIPTION OF THE FIGURES

In order that the manner in which the above recited objectives are realized, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which.

DETAILED DESCRIPTION OF THE DISCLOSED EMBODIMENTS

Figure 1:
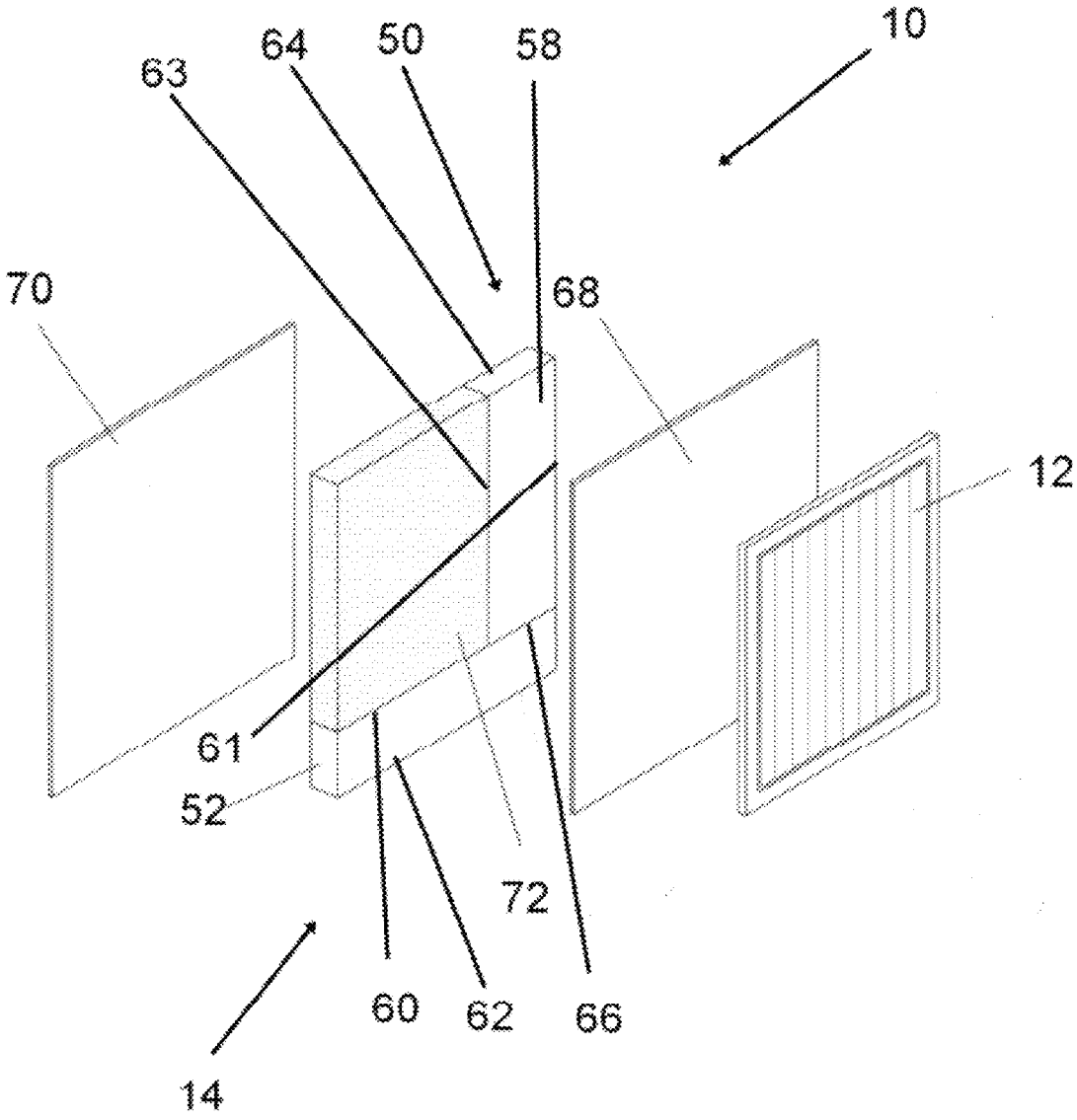
FIG. 1 illustrates an exploded view of a disclosed overhead sectional door according to an embodiment of the invention.

FIG. 1 illustrates components of sectional overhead garage door 10 according to a disclosed embodiment. There are two principle components of the garage door. The first component is the door face panel 12. The second component is the core 14, which supports the face panel 12.

The face panel 12 is fabricated from one or more exterior grade medium-density fiberboard (MDF) panels. The benefits of MDF is its consistent strength and its ability to be routed without chip-out due to its isotropic construction. It is to be appreciated that other exterior grade sheet materials suitable for routering could be used in place of MDF while falling within the scope of the disclosed embodiments. For example, high density urethane (HDU) or PVC could be used.

The MDF panels are milled, via a CNC controlled router, to include window openings as well as the typical multi-raised or inset panel design found on a standard garage door. The result is a unitary, i.e., substantially single piece, panel having windows and other designs milled into the panel. As can be appreciated, router bits would need to be interchanged to create straight cuts, e.g., for windows, or groove cuts, e.g., for the raised or inset multi-panel designs.

MDF is typically obtained in sizes of four feet wide by eight feet tall, and a garage door is typically seven to eight feet tall. However, a garage door is typically eight to nine feet wide for a single door or sixteen feed wide for a double door. Accordingly, plural MDF panels are milled with the CNC to obtain a full garage door.

Figure 2:
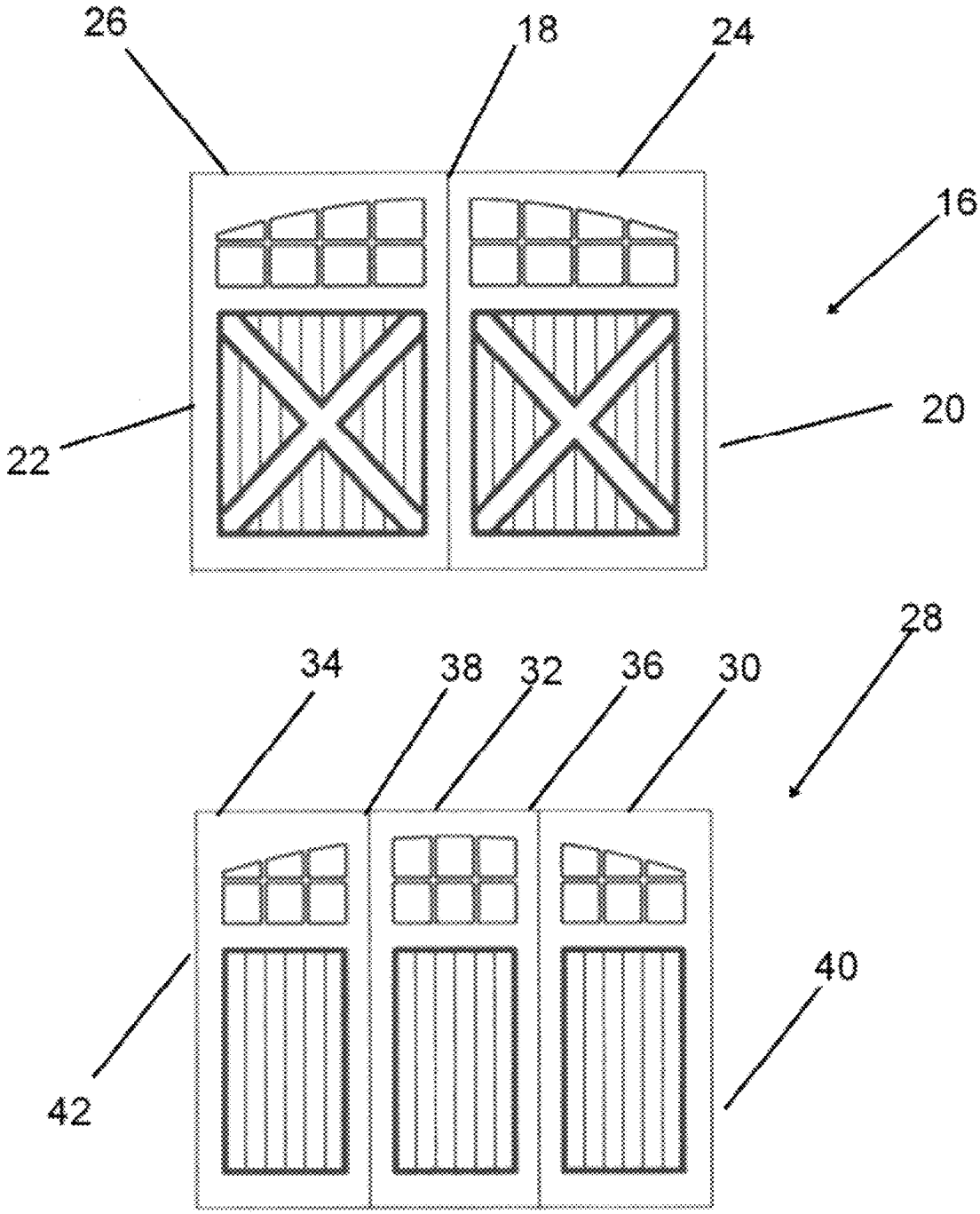
FIG. 2 illustrates two designs according to the disclosed embodiment.

For example, FIG. 2 illustrates two different unitary designs, i.e., designs which extend over a large portion of the face panel of the garage door. The first is a barn-door style garage door 16. A widthwise center seam or kerf 18, between width-wise exterior, right and left edges 20, 22 of the door 16, is the location where two MDF 24, 26 panels meet.

Alternatively, in a garage door 28 with a tri-fold appearance, three MDF panels 30, 32, 34 may be utilized. Utilizing three panels creates two widthwise seams 36, 38 between widthwise exterior right and left edges 40, 42, of the door. The widthwise kerfs could also be created with a saw or with the CNC, if necessary.

While two panels are particularly well suited for an eight foot wide door, and three panels are particularly well suited for a twelve food door, other widths will be required as by design. For such circumstances, when complete door panels cannot be utilized, spacers strips or filler strips can be placed on the outside edges 20, 22 of the door as well as between the door panels 24, 26. The seams created between around the panels can be wood filled to create a smooth, seamless finish.

The thickness of the face panels enables a router bit to mill the depth of a CNC programmed unitary design, such as a multi-panel raised design, without passing completely through the face panel 12. For example, designs illustrated in FIG. 2, excluding the windows, are about three-eighths of an in deep. This is the thickness of a typically multi-panel design. As such, the panels are approximately half an inch deep. Window cuts, on the other hand, require cutting through the full depth of the panels, e.g., a full half inch.

It is to be appreciated that the full depth of the face panel is routed out when the unitary design is an inset multi-panel design. In such circumstances, the core members, such as the front face of the front stabilizing panel, discussed below, provides the face surface of the inset panel. However, the stabilizing panel is not milled in this process.

The sectional-overhead, as with typical garage doors, is comprised of plural sections. Each section is width-wise the same as the width of the overall garage door, and height-wise shorter than the door. A typical seven foot tall garage door could be divided into three segments and an eight foot tall garage door could be divided into four segments.

Accordingly, each garage door design includes a bottom segment, a top segment, and one or two intermediate segments. The top segment is typically about 28" to allow for proper cutting of window lites and installation of a window glass. The remaining height is then equally distributed among the remaining segments.

Figure 3:
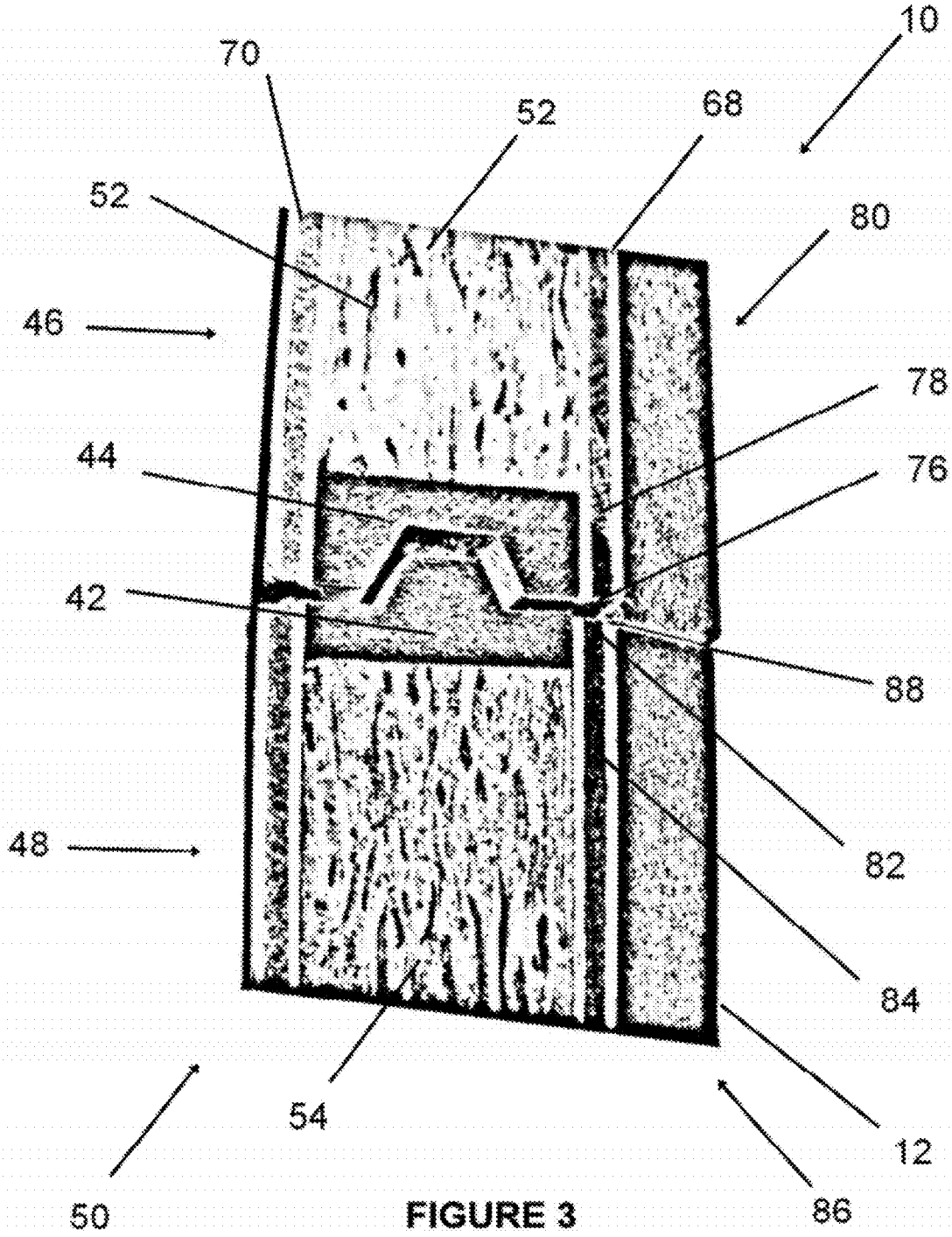
FIG. 3 illustrates the intersection of two sections of the overhead sectional door according to the disclosed embodiment.

At intersecting seams between adjacent segment members, as illustrated in FIG. 3, the garage door includes tongue 42 and grove 44 members. The tongue and grove members enable the adjacent segments 46, 48 to seat against each other without allowing water to penetrate from the outside (e.g., side with face panel 12) to the inside of the garage door. As can be appreciated, water penetration is optimally avoided when the tongue 42 points vertically upward, into the groove 44.

The tongue and groove members are made from wood, such as finished cedar, which is a highly rated weather resistant wood. The length of the tongue and groove members is the width of the garage door. The nominal width of the tongue and groove members is one and one-quarter inches. This is the thickness of the center Structure of the core, disclosed below.

The nominal height of the tongue and groove members is about nine-sixteenths of an inch. This nominal height enables cutting about a one-quarter inch rise in the tongue and a five-sixteenths of an inch rise in the groove, both of which can be cut from a router or shaper. The difference in the tongue and groove dimensions prevents binding as would be appreciated by one skilled in the art.

Figure 4:
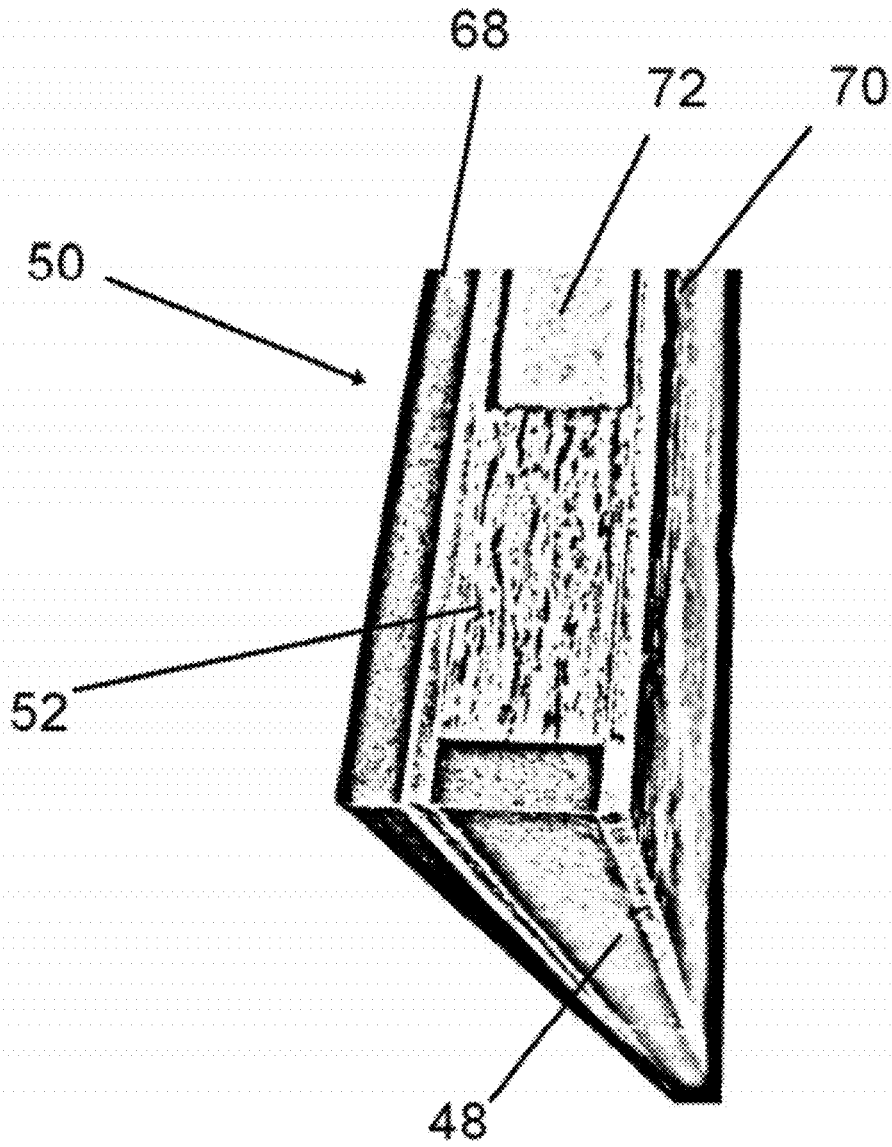
FIG. 4 illustrates a cross section of a bottom section of the overhead sectional door according to the disclosed embodiment.
Figure 5:
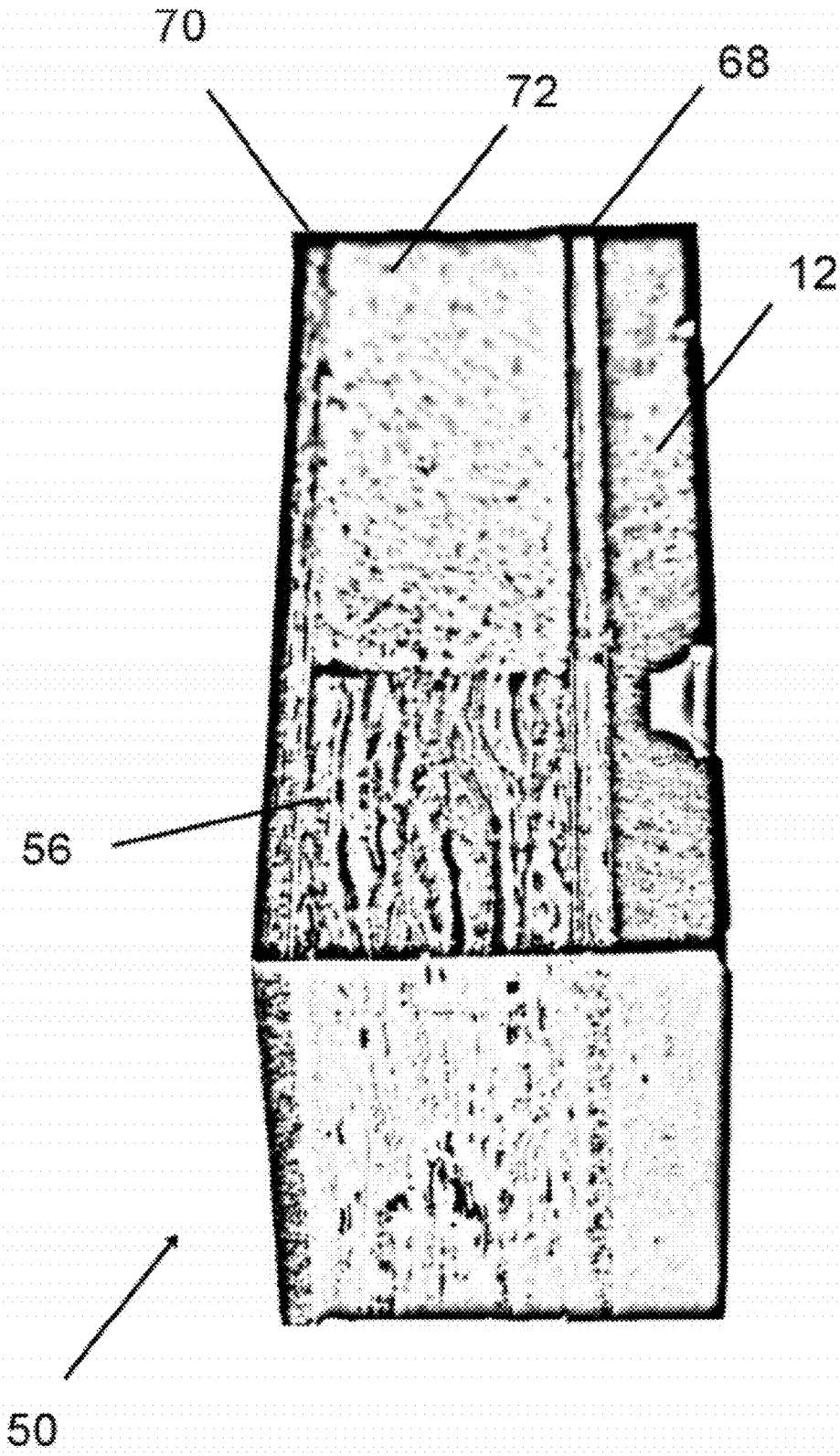
FIG. 5 illustrates a cross section of top, left side edge of the overhead sectional door according to the disclosed embodiment.

The bottom section of the sectional door does not need a tongue or groove. However, as illustrated in FIG. 4, this section has a weather-resistant bottom trim 48. The bottom trim 48 has the same nominal height as the tongue and groove members and is fabricated from the same material.

The width of the bottom trim is illustrates as being the same as the tongue and groove members. However, the width of the bottom trim can be wide enough to cover the bottom of front and back stabilizing panels, disclosed below. This would provide a weather proof seal to the entire bottom surface of the core of the garage door.

It is to be appreciated that the top edge of the top section of the garage door, as well as the side edges of each section, do not require weather-resistant trim. This is because these edges are located inside a garage at all times.

As illustrated in FIGS. 1 and 3-5, the core in each section of the sectional overhead door includes a center framing structure 50. The framing structure is defined by a pair of bottom and top rails 52, 54 and a pair of left and right 56, 58 side stiles. Additional intermediate styles can be applied to provide proper structural support to the individual sections.

For example, a bi-fold door in a single car garage would include three intermediate styles. One would be a center style, positioned behind the seam connecting the left and right face panels. As for the other two stiles, one would be positioned on either side of the center stile, bisecting the remaining space. On a tri-fold door in a single-car garage, the there would two intermediate styles, one behind the connecting seams for each of the adjacent face panels.

The framing structure is manufactured from laminated strand lumber (LSL). LSL is stronger than wood and will not split when anchored with hardware required for holding together adjacent sections of the sectional overhead garage door.

The rails and stiles have a thickness of about an inch and a quarter. Except for the very top and bottom rails, the rails have a height, e.g., between top and bottom surfaces 60, 62 of the bottom rail 52, of about two inches. The width of the styles, e.g., between inside and outside surfaces 61, 63 of the right style 58, is the same dimension as the height of the rails.

The top and bottom rails have a height that is typically greater than the other rails. The height of the top rail is between four and five inches, depending on the weight of the door as well as, for example, the open space above the inserted lites, discussed below. That is, the top rail can serve as trim for the exposed inside core frame, above the glass.

The bottom rail has a height between three and five inches, depending on the weight and height of the door. A door greater in height than eight feet may required a larger bottom rail to act as a support for additional spacer or filler material.

The rails have a length which spans the entire width of the garage door. The stiles have a height, e.g., between top and bottom surfaces 64, 66 of the right stile 58, which is the same as the height for each section, less the depth of the top and bottom rails, and, as utilized, the thickness tongue and groove members, and bottom trim.

The core includes front and rear support panels 68, 70. The support panels are, for example, one quarter inch plywood, e.g., luan plywood. The support panels function as an effective truss, stabilizing the core and preventing the rails and stiles from shifting, in the plane of the core, out of a squared relationship. Such shifting could occur, e.g., from shear loadings which may be applied to the core during manufacture, transport, installation or during normal use. The front support panel also creates a large surface for mounting the face panels, as will be discussed.

The core includes insulating material 72 disposed in the void between the rails, stiles and stabilizing panels. The insulating material consist of, for example, sheets of polystyrene.

Forming each core member is performed by, for example, cutting the rails and stiles, as well as the tongue and groove members and the bottom trim. Once cut, these members are assembled, via, e.g., nails or screws, to form the core frames of the different sections of the garage door.

Once the different core sections are individually assembled, plural rear support panels 70, one for each section of the sectional overhead door, are cut. The rear support panels 70 are cut slightly larger than required. The rear support panels 70 are then nailed, with, e.g., finishing nails, and glued to the rear surface of the rails and stiles of the respective sections of the sectional overhead door.

The core members, with the rear support panel installed, are laid down, with the rear support panel facing downward, so that the sheets of insulation can be installed. The insulation is fabricated from polystyrene having a high insulation value, e.g., R value. For example, the insulating member is manufactured from a high density urethane. However, the sheets of insulation are not installed in the top core segment if that segment will be cut to include windows.

After the insulation is installed, the core frames are each fitted with a front support panel. Each front support panel is installed in the same way the rear support panels were installed. The resulting structure is a hollow core assembly filled with insulation.

At this time, the sections, fully assembled, are placed into a press, such as a vacuum or hydraulic press. For example, when using the vacuum press, the assembled sections are placed inside a polyurethane bag connected to the vacuum press in a typical fashion. The air is removed from the bag by vacuum action, which creates a pressurized encapsulation around the assembled sections. The pressure is maintained until the glue is dry. Once the glue sets, the sections are removed from the press and the edges of the sections are deburred.

It is to be appreciated that the overhang from the support panels creates a burr around the perimeter of the core. Accordingly, once the glue is dry, the core is deburred. Allowing for deburring typically provides a better fit than attempting to cut the support panels exactly to the size of the core frame. However, cutting to the exact size of the core frame, without accounting for deburring, is also within the scope of the disclosed embodiments.

The above disclosed process for installing the support panels and insulation may be modified as would be appreciated by one skilled in the art. The order of installation of support panels is not limited. Furthermore, it is conceivable that'both support panels could be installed simultaneously, so long as insulation is properly installed. An ordinary skilled craftsman could create a jig for such a process.

Once the front and rear support panels are installed, if the top section of the sectional overhead door is to be fitted with windows, that section is further processed. Specifically, the front and rear support panels are further cut away, e.g., via routing, between opposing inside edges of the rails and styles. For example, the inside edge of the bottom rail 52 is edge 60 and the inside edge of the right hand stile 58 is edge 63. The resulting structure for this section is a core frame, with a grove member on the bottom rail, and a luan frame surrounding only the outside of the rails, stiles and the groove member.

The bottom, intermediate and top sections are assembled so that the sections take the form the complete sectional overhead garage door, e.g., as the door would appear when installed and in a closed configuration. A small spacing between the segments is provided for reasons which will be disclosed.

The face panel is laid on top of the front support panel and glued. As indicated, the front support panel provides a large surface area for receiving glue. This insures a firm and permanent connection between the core and the face panel. It also assures that the face panel will not warp over time, i.e., from humidity, as it is entirely restrained against the support panel.

Once the face panel is glued to the several core segments, a saw, e.g., a using a circular saw blade, is passed along the connecting seams between adjacent sections. For example, in FIG. 3, the blade is passed between the bottom edge of 78 of the front support panel 78 in the top section 80 and the top edge 82 of the front support panel 84 in the bottom section 86.

As illustrated in FIG. 3, the blade is disposed to create a seam pitched at a ten degree downward angle, so that water tends to drain towards the outside of the garage door. Regarding the spacing between the adjacent panels 80, 86, this spacing ensures that the saw blade will not cut, for example, the front luan support panels 78, 84 during the saw application.

Once the face panels are connected to the assembled core assemblies, the assembled sections are placed in the press, again. The sections remain in the press until the glue connecting the face panels and core assemblies has cured.

Glass is now installed on through backside of the top segment of the garage door. The glass is held in place with appropriate materials, such as putty and nailed trim. Double and triple glazings can be installed as an alternative.

At this point, the garage door has taken the form of the completed garage door. The door is finished with wood fill of any nail holes and priming. Appropriate hardware can be bolted into the LSL members so that the door can be installed in a prepared garage door opening.

The resulting door has been formed by using a CNC to mill any and all possible designs into, but not through, the face member. The core of the door has a uniform thickness so as to provide a uniform resistance to heat losses through the door.

Turning briefly back to FIG. 1, the core is illustrated with only one rail and one stile and with insulation. No tongue or groove member or bottom trim is illustrated. However, it is to be appreciated that FIG. 1 is a simplification of the basic components of the disclosed garage door.

In addition to the above disclosed features of the invention, a weatherproof gasket may be provided at the bottom edge of the garage door. The material for the gasket can be, for example, rubber. Such a gasket would prevent water, snow, dirt and the like from passing under the garage door when the door is closed.

In the above disclosed embodiment, the front and rear support panels serve as a veneer for enclosing the LSL core frame structure. One benefit from such an enclosure is to seal the insulation in the LSL frame of the core. Another benefit is to visually conceal the LSL frame structure from the rear of the garage door. Yet another benefit is to prevent the garage door segments from undergoing strain deformation.

In an alternative embodiment, structure for preventing strain deformation could be in the form of "L" brackets at the joints for the LSL rails and slats. Alternatively, one or more properly mitered diagonal frame members could be introduced in the plane of the core members. Such frame members could also be fabricated from LSL. Insulation could be provided around these brackets and/or diagonal frame members.

If the support panels were not required for preventing strain deformation, one or both of the support panels could be omitted. The MDF face panel could be glued directly against the front of the core segments. In such a configuration, enough surface area of the front of the LSL core frame would be required to securely support the MDF face panel while also preventing the MDF face panel from warping.

It is to be appreciated that the introduction of one or more diagonal support members in the core frame could provide sufficient surface area to support the face panel with glue. Moreover, the rear veneer of the core segments could be thin PVC or other coating which serves only to conceal the core structure and encapsulate the insulation.

Accordingly, the disclosed embodiments are directed to a sectional overhead door manufactured from sheet material which can be milled on a CNC to form infinite designs and sizes. The sheet material is then laminated on to the base door.

The disclosed embodiments reduce the equipment costs for manufacturing a custom door. That is, it is cost prohibitive to fabricate custom doors based on individual client designs as platens or dies may be rarely reused. As the CNC can be programmed to mill any design, in any size, its use eliminates the expense of having platens or dies made to produce a particular design in a particular size.

In addition to reducing equipment costs, the disclosed embodiments reduce the labor cost for manufacturing a custom door. This is because the operational costs for milling a design into sheet material with a CNC machine is less than for a skilled craftsman to hand mill and fit each milled board to a base door.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

I claim:

1. A sectional overhead door comprising:

plural height-wise adjacent door sections, including a bottom section, at least one intermediate section and a top section, each having substantially the same width;

said sections each comprising:

a unitary face panel having a front surface and a planar rear surface; and a planar core assembly that comprises a hollow center frame having a uniform thickness;

said center frame comprising plural rails and stiles;

wherein a front surface of said core assembly supports said rear surface of said face panel; and each face panel in said intermediate section and one or both of said top and bottom sections having a portion of a unitary face panel design, said unitary design comprising grooves routed into said panel front surfaces such that the unitary design is provided without utilizing trim boards on said panel front surfaces, said routed design groves not extending into said core assembly;

wherein at least a plurality of the design grooves continuously span at least height-wise over said intermediate section and said one or both of said top and bottom sections, such that when said plural door sections are height-wise aligned in a closed-door configuration, the unitary design is provided.

2. The door of claim 1, wherein each face panel in said intermediate section and both of said top and bottom sections having a portion of a unitary face panel design that continuously spans at least height-wise over said intermediate section and said both of said top and bottom sections such that when said plural door sections are height-wise aligned in a closed-door configuration, the unitary design is provided.

3. The door of claim 1 comprising at least one stabilizing member in said core assembly.

4. The door of claim 3 wherein:

said stabilizing member comprises plural planar support panels including a front planar support panel and a rear planar support panel;

said front support panel having a front surface supporting said rear surface of said face panel, said routed design grooves in said face panel not extending into a front face of said front planar support panel of said core assembly.

5. The door of claim 4 wherein said face panel in said top section is a top face panel, said core assembly in said top section is a top core assembly; and said top face panel includes window openings, and said front and rear support panels of said top core assembly are routed such that said top core assembly, which supports said top face panel, is a hollow frame.

6. The door of claim 5 wherein:

each door section includes plural unitary face panels, positioned widthwise adjacent to each other; and each of said plural face panels in said bottom and intermediate sections having a portion of a unitary design routed into said panel front surface such that when said plural door sections are aligned in a closed-door configuration, the unitary design is provided.

7. The door of claim 6 wherein that a seam, from a top to a bottom of said assembled door, is created between said adjacent face panels.

8. The door of claim 6 wherein spacer strips are positioned between said plural unitary face panels on each door section.

9. The door of claim 6 including insulation disposed in said core assemblies of said intermediates and bottom sections.

10. The door of claim 9 wherein said intermediate section comprises two intermediate sections.

11. The door of claim 9 including mating tongue and groove members on opposing bottom and top edges of adjacent door sections.

12. The door of claim 11 including a weather resistant member as a bottom edge of the bottom section.

13. The door of claim 12 wherein said face panels are glued to respective ones of said core assemblies.

14. The door of claim 13 wherein said front and rear support panels are glued and clamped to said rails and stiles in each of said respective core assemblies by vacuum or hydraulic pressure until said glue cures.

15. The door of claim 13 wherein said unitary design is a bi-fold barn door including a plurality of raised panels.

16. The door of claim 13 wherein said unitary design is a tri-fold barn door including a plurality of raised panels.

17. The door of claim 13 wherein said unitary design is a bi-fold barn door including a plurality of inset panels.

18. The door of claim 13 wherein said unitary design is a tri-fold barn door including a plurality of inset panels.

19. The door of claim 13 wherein a top rail and a bottom rail for said door have a height which is greater than other rails in said door.

20. The door of claim 19, wherein said rails and stiles are manufactured from engineered or solid wood, the face panel is manufactured from an exterior grade sheet material, and the support panels are manufactured from an engineered wood.

21. The door of claim 20 wherein said rails and stiles are manufactured from laminated strand lumber, the face panel is manufactured from medium density fiber board, and the support members are manufactured from Luan plywood.

* * * * *